US006200053B1

(12) United States Patent
Asami et al.

(10) Patent No.: US 6,200,053 B1
(45) Date of Patent: Mar. 13, 2001

(54) INK FOLLOWER COMPOSITION FOR BALLPOINT PEN AND BALLPOINT PEN USING THE SAME

(75) Inventors: Hideaki Asami, Aichi; Toshiji Yokotani, Tokyo, both of (JP)

(73) Assignee: The Pilot Ink Co., Ltd., Aichi (JP)

( * ) Notice: Subject to any disclaimer, the term of this patent is extended or adjusted under 35 U.S.C. 154(b) by 0 days.

(21) Appl. No.: 09/458,667

(22) Filed: Dec. 10, 1999

(30) Foreign Application Priority Data

Dec. 11, 1998 (JP) ..... 10-375064

(51) Int. Cl.[7] ..... B43K 7/08
(52) U.S. Cl. ..... 401/142; 106/31.13; 523/161
(58) Field of Search ..... 401/141, 142, 401/221; 106/31.13, 31.01; 523/161, 1

(56) References Cited

U.S. PATENT DOCUMENTS 3,656,857 * 4/1972 Seregely ..... 401/142
5,874,488 * 2/1999 Wang et al. ..... 523/161

FOREIGN PATENT DOCUMENTS 0 792 759 A2 9/1997 (EP) .
57-200472 12/1982 (JP) ..... C09K/3/00
64-10554 2/1989 (JP) ..... C09K/3/00
6-33025 5/1994 (JP) ..... B43K/7/02
7-17872 3/1995 (JP) ..... C09D/11/18

* cited by examiner

*Primary Examiner*—David J. Walczak
(74) *Attorney, Agent, or Firm*—Sughrue, Mion, Zinn, Macpeak & Seas, PLLC

(57) ABSTRACT

An ink follower composition for ballpoint pens which comprises (1) a hardly volatile liquid and (2) expansible synthetic mica having a quaternary ammonium ion introduced therein or an ink follower composition for ballpoint pens which comprises (1) a hardly volatile liquid, (3) synthetic mica, and (4) a thickener, and a ballpoint pen having the ink follower composition. The ink follower composition follows ink without leaving ink behind on the inner wall of an ink container.

8 Claims, 1 Drawing Sheet

INK FOLLOWER COMPOSITION FOR BALLPOINT PEN AND BALLPOINT PEN USING THE SAME

FIELD OF THE INVENTION

This invention relates to an ink follower composition for a ballpoint pen and a ballpoint pen using the same. In particular, in a ballpoint pen having a ball point tip and an open-ended ink container containing middle- to high-viscosity or shear-thinning ink, the present invention relates to an ink follower composition for ballpoint pen which is applied to the end of ink in the open-ended ink container.

BACKGROUND OF THE INVENTION

In ballpoint pens using high-viscosity oil-base ink, a mixture of a mineral oil and a metallic soap (i.e., grease) has been used as an ink follower composition also called "liquid stopper" or "a back flow preventing composition".

When applied to ballpoint pens using middle-viscosity oil-base ink or shear-thinning aqueous ink, the ink follower applicable to the high-viscosity oil-base ink does not follow the ink satisfactorily or fails to prevent the ink from flowing backward because of its large viscosity change with temperature. Hence, various gelatinous polybutene-based ink followers comprising a hardly volatile organic liquid, typically exemplified by liquid polybutene, and a thickener have been proposed and put to practical use broadly in ballpoint pens using the aforementioned ink.

Conventional thickeners include dibenzylidene sorbitol, tribenzylidene sorbitol (see JP-B-1-10554), N-acylamino acid derivatives (see JP-A-57-200472), clay having been surface-treated with an onium compound having a long-chain alkyl group (see JP-B-7-17872 corresponding to U.S. Pat. No. 4,671,691), and silica having been surface-treated with a hydrophobic group (see JP-B-6-33025). The terms "JP-A" and "JP-B" as used herein mean an "unexamined published Japanese patent application" and an "examined Japanese patent publication", respectively.

The ink follower comprising the hardly volatile liquid and the conventional thickener is used to plug the end of ink contained in a transparent or semitransparent ink tube so as to prevent ink from evaporating and from flowing backward even when the ballpoint pen is left to stand for a long period of time with its tip upward or when a shock is given to the ballpoint pen by, for example, dropping. However, when the ink follower follows the ink with the ink consumption, it moves with the ink adhering to the inner wall of the ink container. As a result, a certain amount of the ink remains on the inner wall uselessly so that the writing length is shorter than what should have been expected from the amount of the ink in the container. Besides, the ink staining the inner wall not only makes the remainder of the ink invisible but deteriorates the appearance.

SUMMARY OF THE INVENTION

An object of the present invention is to eliminate the above-mentioned disadvantages of conventional ink followers for ballpoint pens. That is, an object of the invention is to provide an ink follower composition for a ballpoint pen which leaves no ink behind as adhered to the inner wall of the ink container and thereby provides a ballpoint pen that secures a writing length as expected and has visibility for confirming the residual amount of the ink and good appearance.

As a result of extensive investigations, the present inventors have found that an ink follower composition accomplishing the above object can be obtained by adding synthetic mica to a hardly volatile liquid.

The invention provides an ink follower composition for a ballpoint pen which comprises a hardly volatile liquid and expansible synthetic mica having a quaternary ammonium ion introduced therein and an ink follower composition for a ballpoint pen which comprises a hardly volatile liquid, a thickener, and synthetic mica.

The invention embraces an ink follower composition for a ballpoint pen in which the synthetic mica is present in an amount of 0.2 to 30% by weight based on the total composition; an ink follower composition for a ballpoint pen in which the hardly volatile liquid is polybutene, an α-olefin cooligomer or a mixture thereof; an ink follower composition for a ballpoint pen in which the hardly volatile liquid is dimethyl silicone oil, methylphenyl silicone oil, alkyl-modified silicone oil or a mixture thereof; an ink follower composition for a ballpoint pen which further comprises atactic polypropylene; and an ink follower composition for a ballpoint pen in which the composition has a 1-minute value of from 25 to 50 mm as measured with a spreadmeter at 20° C.

The invention also provides a ballpoint pen comprising a middle- to high-viscosity ink or shear-thinning ink, a ball, a tip for holding said ball at the top end thereof and for discharging the ink from the top end thereof, an ink container for containing the ink and for supplying the ink to the tip, the ink container communicating with the rear of the tip either directly or via a connecting member, and the above-described ink follower composition which is applied to the rear end of the ink and follows the ink with ink consumption.

The ink follower composition according to the invention follows ink as ink is consumed without leaving the ink behind on the inner wall of the ink container. Therefore, a user can confirm the residual amount of ink, and the ballpoint pen using the ink follower secures the expected writing length with stable ink feed on use. The ink follower composition of the invention has little temperature dependence of viscosity in a practical temperature range and is excellent in stability with time and impact resistance. Therefore it performs its function, keeping the interface with ink without undergoing liquid separation or causing back flow of ink.

DETAILED DESCRIPTION OF THE INVENTION

Figure 1:
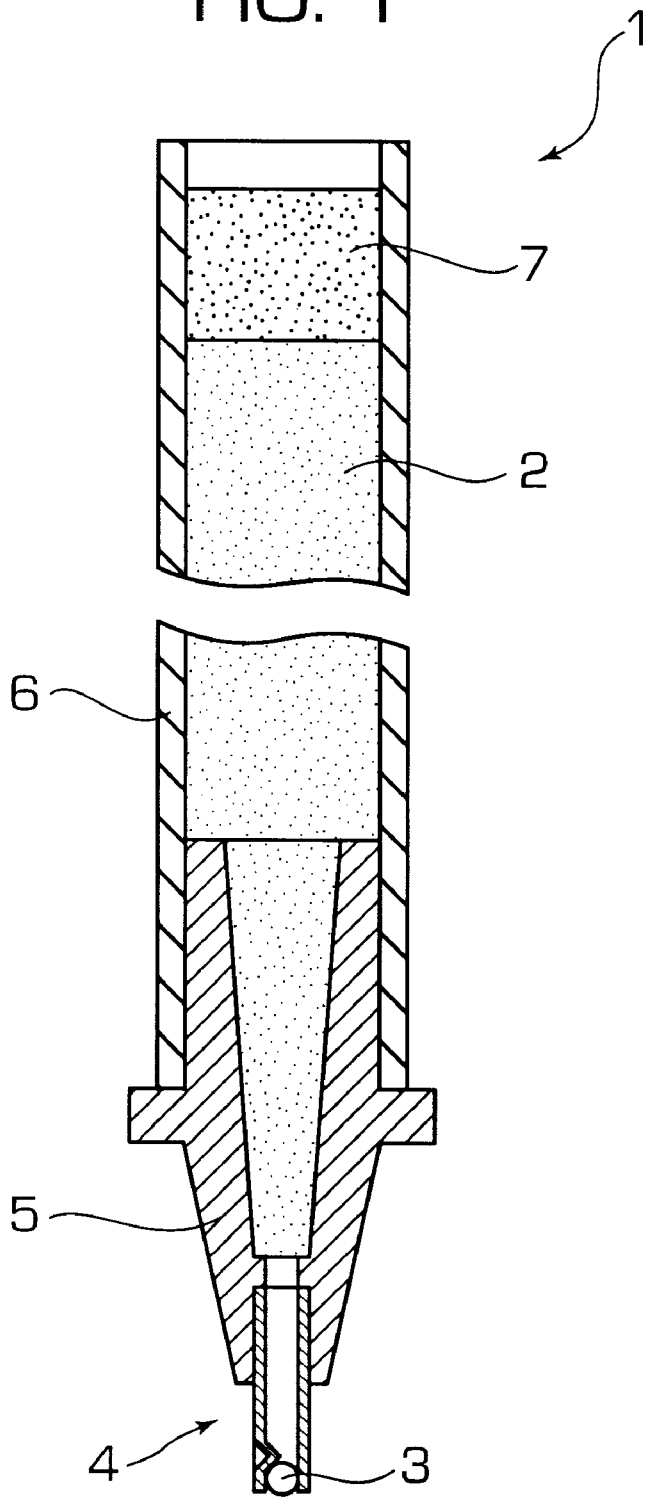
FIG. 1 shows a ballpoint pen 1 in accordance with the present invention, including ink 2, ball 3, tip 4, connecting member 5, ink container 6 and ink follower composition for a ballpoint pen 7.

Expansible synthetic mica having a quaternary ammonium ion introduced therein which can be used in the invention is a kind of synthetic mica. While it is added for the purpose of improving visibility, it also serves to thicken a hardly volatile liquid, which exclude the necessity to add other thickeners. Expansible synthetic mica having a thickening effect includes one having a quaternary ammonium ion represented by formula (I):

(I)

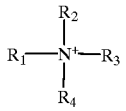

wherein $R_1$, $R_2$, $R_3$, and $R_4$ each represent an alkyl group having 8 to 22 carbon atoms; or $R_1$ represents a hydrogen atom or an alkyl group having 1 to 30 carbon atoms, $R_2$ and $R_3$ each represent $(CH_2CH_2O)_nH$, $(CH_2CH_2CH_2O)_nH$, $(CH_2CH(CH_3)O)_nH$ or an alkyl group having 1 to 30 carbon atoms, and $R_4$ represents $(CH_2CH_2O)_nH$, $(CH_2CH_2CH_2O)_nH$ or $(CH_2CH(CH_3)O)_nH$, wherein n is 1 to 50.

Where the quaternary ammonium ion represented by formula (I) contains a hydroxypolyoxyethylene group or a hydroxypolyoxypropylene group, the oxygen or the terminal proton shows affinity with the hardly volatile liquid and expands the distance between layers of sheet silicate thereby to produce a stable thickening effect owing to the negative charges on the plane of the layers and the positive charges on the edges of the layers.

Incorporation of the quaternary ammonium ion into synthetic mica can be achieved with quaternary ammonium salts containing the ion, such as the salts with $Cl^-$, $Br^-$, $NO_3^-$, $OH^-$, $CH_3COO^-$, etc.

Of the above-described hardly volatile liquids, polybutene and α-olefin cooligomers are suitable to have their viscosity increased by addition of the expansible synthetic mica having a quaternary ammonium ion.

Improvement on visibility can also be achieved with synthetic mica that does not have a thickening effect on the hardly volatile liquid. Such synthetic mica includes expansible mica and non-expansible mica. The expansible mica includes fluoromica (hydroxyl groups are substituted with fluorine) having a lithium ion or a sodium ion as an intercalant.

In using synthetic mica having no thickening effect, addition of a thickener is required. Useful thickeners include acylated amino acids, dibenzylidene sorbitol, tribenzylidene sorbitol, dextrin fatty acid esters, inorganic particles such as hydrophobic silica and hydrophilic silica, and metal soaps such as aluminum soaps and lithium soaps.

Hardly volatile liquids to which the synthetic mica and a thickener are to be added include polybutene, α-olefin cooligomers, dimethyl silicone oil, methylphenyl silicone oil, and alkyl-modified silicone oil. In a preferred embodiment, the hardly volatile liquid is polybutene, an α-olefin cooligomer or a mixture thereof. In yet another preferred embodiment, the hardly volatile liquid is dimethyl silicone oil, methylphenyl silicone oil, alkyl-modified silicone oil or a mixture thereof. Where dimethyl silicone oil, methylphenyl silicone oil or alkyl-modified silicone oil is used, the above-mentioned expansible synthetic mica having a quaternary ammonium ion can be used as synthetic mica.

The amount of the synthetic mica to be added is suitably in a range of from 0.2 to 30% by weight, preferably 3 to 20% by weight, based on the total composition. Less than 0.2% of the synthetic mica is insufficient for appreciable improvement on visibility. Where more than 30% of the synthetic mica is added, the visibility is satisfactory, but the resulting composition has too high viscosity and hardly follows the ink movement only to deteriorate the ballpoint pen performance.

The hardly volatile liquids generally used as a base oil of the ink follower of the invention include silicone oils which has transparency, lubricating properties, heat resistance, and oxidation resistance, such as dimethyl silicone oil, methylphenyl silicone oil, and alkyl-modified silicone oil (e.g., KF410 available from Shin-Etsu Silicone Co. Ltd., TSF4420 available from Toshiba Silicone Co., Ltd., and SH 203, SH230 and SF 8416 available from Dow Corning Toray Silicone Company, Limited), polybutene, and α-olefin cooligomers (e.g., HC-100 and HC-150 available from Mitsui Petrochemical Industries Ltd.). The α-olefin cooligomers include those comprising two or more α-olefins and those comprising ethylene and an α-olefin.

The hardly volatile liquid to be used has a kinematic viscosity of 500 to 30,000 cSt, preferably 800 to 20,000 cSt, at 20° C. If the kinematic viscosity is lower than 500 cSt, the ink follower tends to have insufficient impact resistance. If the kinematic viscosity exceeds 30,000 cSt, the ink follower tends to have poor properties of following ink. The kinematic viscosity may be measured by, for example, the method described in JIS K2283.

In a preferred embodiment of the invention, atactic polypropylene is added to the ink follower composition to provide an ink follower composition which follows ink satisfactorily and hardly flows backward even on receipt of impact. Atactic polypropylene is a propylene polymer having propylene molecules bonded with steric irregularity which is by-produced in a proportion of several percents in the manufacture of isotactic polypropylene (propylene polymer having steric regularity). The molecular weight of atactic polypropylene varies depending on the solvent or separating temperature used in the manufacture. The one suitably used in the invention has a molecular weight of 1,000 to 50,000, particularly 5,000 to 30,000; for it exhibits excellent dispersibility in the hardly volatile liquid to impart moderate tack for preventing drooling and thereby to provide an ink follower having excellent impact resistance.

The atactic polypropylene can be added in an amount of 0.2 to 30% by weight, particularly 1 to 25% by weight, based on the total composition. Addition of less than 0.2% produces insubstantial effect on impact resistance, and addition of more than 30% results in too high viscosity only to impair the ink following properties.

The hardness and flowability of an ink follower can be measured conveniently with a spreadmeter. An ink follower having a 1-minute value of 25 to 50 mm as measured with a spreadmeter at 20° C. exhibits suitable performance properties. An ink follower having a 1-minute value smaller than 25 mm tends to be too hard to follow ink, while one having a 1-minute value greater than 50 mm is so soft that it may tend to move backward when the ballpoint pen is left to stand with its tip upward or some shock is imposed to the ballpoint pen by, for example, dropping. Measurement of hardness using a spreadmeter can be carried out in accordance with the method described in "Shikizai no bunseki-shikenho handbook" published by Maruzen, or the like.

The ink follower composition of the invention is prepared by mixing the hardly volatile liquid and synthetic mica and, if necessary, a thickener together with other necessary additives by stirring in a disper under, if necessary, heating. If desired, the mixture can be kneaded in a three-roll mill.

The ink follower according to the invention is applied at the rear end of the ink filling an ink container and is to follow the ink with ink consumption while preventing evaporation of the ink and back flow of the ink even when the ballpoint pen is allowed to stand with its tip upward or in case of a shock. The ink follower composition of the invention can be used in combination with a known solid ink follower.

The ink used in the invention includes conventional aqueous or oil-base inks.

The oil-base ink is preferably middle- to high-viscosity ink having a viscosity of 1 to 20 Pa·s, particularly 1 to 10 Pa·s. The aqueous ink to be used is preferably shear-thinning aqueous ink.

Coloring matter which can be used in the oil-base ink include dyes classified as solvent dyes according to Color Index. Specific examples of solvent dyes are Valifast Black 3806 (C.I. Solvent Black 29), Valifast Black 3807 (a trimethylbenzylammonium salt of C.I. Solvent Black 29), Spirit Black SB (C.I. Solvent Black 5), Spiron Black GMH (C.I. Solvent Black 43), Valifast Red 1308 (a salt of C.I. Basic Red 1 and C.I. Acid Yellow 23), Valifast Yellow AUM (a salt of C.I. Basic Yellow 2 and C.I. Acid yellow 42), Spiron Yellow C2GH (an organic acid salt of C.I. Basic Yellow 2), Spiron Violet CRH (C.I. Solvent Violet 8-1), Valifast Violet 1701 (a salt of C.I. Basic Violet 1 and C.I. Acid Yellow 42), Spiron Red CGH (an organic acid salt of C.I. Basic Red 1), Spiron Pink BH (C.I. Solvent Red 82), Nigrosine Base EX (C.I. Solvent Black 7), Oil Blue 603 (C.I. Solvent Blue 5), and Neozapon Blue 808 (C.I. Solvent Blue 70).

Coloring matter which can be used in the aqueous ink include dyes that are soluble or dispersible in aqueous media, such as acid dyes, basic dyes, and direct dyes.

Specific examples of suitable acid dyes are New Coccine (C.I. 16255), Tartrazine (C.I. 19140), Acid Blue Black 10B (C.I. 20470), Guinea Green (C.I. 42085), Brilliant Blue FCF (C.I. 42090), Acid Violet 6B (C.I. 42640), Soluble Blue (C.I. 42755), Naphthalene Green (C.I. 44025), Eosine (C.I. 45380), Phloxine (C.I. 45410), Erythrosine (C.I. 45430), Nigrosine (C.I. 50420), and Acid Flavin (C.I. 56205).

Specific examples of suitable basic dyes are Chrysoidine (C.I. 11270), Methyl Violet FN (C.I. 42535), Crystal Vioelt (C.I. 42555), Malachite Green (C.I. 42000), Victoria Blue FB (C.I. 44045), Rhodamine B (C.I. 45170), Acridine Orange NS (C.I. 46005), and Methylene Blue B (C.I. 52015).

Specific examples of suitable direct dyes include Congo Red (C.I. 22120), Direct Sky Blue 5B (C.I. 24400), Violet BB (C.I. 27905), Direct Deep Black EX (C.I. 30235), Kayarus Black G Conc (C.I. 35225), Direct Fast Black G (C.I. 35255), and Phthalocyanine Blue (C.I. 74180).

Pigments can also be used for the oil-base or aqueous ink. Useful pigments include inorganic pigments, such as carbon black, iron oxide, and ultramarine; organic pigments, such as azo pigments, anthraquinone pigments, condensed polyazo pigments, thioindigo pigments, metallic complex salts, phthalocyanine pigments, perinone pigments, perylene pigments, dioxazine pigments, and quinacridone pigments; and fluorescent pigments.

Particulate fluorescent pigments comprising a synthetic resin matrix having dispersed therein a fluorescent dye, pearl pigments, metallic pigments (gold or silver), light-storing pigments, white pigments (e.g., titanium oxide), and reversibly thermochromic encapsulated pigments are also useful.

These dyes or pigments can be used either individually or as a mixture of two or more thereof and comprise from 3 to 40% by weight of the total ink composition.

Organic solvents used in the oil-base ink are preferably high-boiling organic solvents having a boiling point of 150° C. or higher at atmospheric pressure, such as benzyl alcohol, ethylene glycol monophenyl ether (phenyl glycol), benzyl glycol, dipropylene glycol monomethyl ether.

Solvents used in the aqueous ink include water and general-purpose water-miscible or water-soluble organic solvents, such as ethanol, isopropyl alcohol, glycerol, triethanolamine, diethanolamine, monoethanolamine, ethylene glycol, diethylene glycol, thiodiethylene glycol, polyethylene glycol, propylene glycol, ethylene glycol monomethyl ether, ethylene glycol monobutyl ether, ethylene glycol monomethyl ether acetate, sulfolane, 2-pyrrolidone, N-methyl-2-pyrrolidone, and dimethylformamide. The water-soluble organic solvent to be used is selected according to the kind of the dissolution assistant for resins or according to the purposes, such as inhibition of ink drying at the tip.

Conventional materials known for providing shear-thinning properties can be used in the aqueous ink. Water-soluble or dispersible materials are effectively used. Examples of such materials are xantham gum, welan gum, succinoglycan (organic acid-modified heteroglycan composed of a glucose unit and a galactose unit; average molecular weight: about 1,000,000 to 8,000,000), guar gum, locust bean gum and its derivatives, hydroxyethylcellulose, alkyl alginates, polymers mainly comprising an alkyl methacrylate (molecular weight: 100,000 to 150,000), glycomannan, thickening polysaccharides having a gelling property, extracted from seaweed, such as agar and carrageenan, benzylidene sorbitol or benzylidene xylitol and their derivatives, crosslinking acrylic acid polymers, inorganic particles, polyglycerol fatty acid esters, polyoxyethylene sorbitan fatty acid esters, polyethylene glycol fatty acid esters, polyoxyethylene castor oil, polyoxyethylene lanolin-lanolin alcohol-beeswax derivatives, polyoxyethylene alkyl ether-polyoxypropylene alkyl ether, polyoxyethylene alkyl phenyl ether, and nonionic surface active agents having an HLB value of 8 to 12 (e.g., fatty acid amides). These shear-thinning property imparting materials are used either individually or as a mixture thereof. The shear-shinning property imparting materials can be added in an amount of 0.1 to 20% by weight based on the total ink composition.

It is preferred that the ink composition containing the shear-thinning property imparting material be adjusted to have a viscosity of 25 to 160 mPa·s as measured with an EM type rotational viscometer at 25° C. and 100 rpm and to have a shear-thinning index of 0.1 to 0.7. With the viscosity and the shear-thinning index falling within the above preferred ranges, the ink exhibits favorable properties as ink for ballpoint pens, such as ink stability when allowed to stand and satisfactory ink feed on use.

The shear-shinning index (n) can be calculated from empirical formula: $T=Kj^n$, which is obtained through rheological measurements, wherein T is a shear stress, j is a shear rate, and K is a calculated constant.

If desired, water-soluble resins, such as a styrene-maleic acid copolymer, a cellulose derivative, polyvinylpyrrolidone, polyvinyl alcohol and dextrin, may be added for viscosity control.

The ink can contain other various additives, such as pH adjusting agents (e.g., sodium carbonate, sodium phosphate, sodium hydroxide, sodium acetate, triethanolamine, and diethanolamine), antiseptics or antifungals (e.g., carbolic acid, sodium 1,2-benzothiazolin-3-one, sodium benzoate, sodium dehydroacetate, potassium sorbate, propyl p-hydroxybenzoate, and 2,3,5,6-tetrachloro-4-(methylsulfonyl)pyridine), corrosion inhibitors (e.g., benzotriazole, tolyltriazole, dicyclohexylammonium nitrite, diisopropylammonium nitrite, and saponin), wetting agents (e.g., urea, sorbitol, mannitol, sucrose, glucose, reducing starch hydrolyzate, and sodium pyrophosphate), lubricants (e.g., phosphoric ester surface active agents), agents for improving penetrability into paper (e.g., fluorine type surface active agents or nonionic, anionic or cationic surface active agents), antifoaming agents (e.g., dimethylpolysiloxane), dispersants, and the like.

Conventionally and generally employed structures of the tip of ballpoint pens can effectively be applied to the ballpoint pen of the present invention. Examples of useful tips include one comprising a metallic pipe with its point deformed inward by pressing to form a ball-bearing seat in which a rotating ball is held, one made of metal cut and shaped to have a ball-bearing seat, and one comprising a metallic pipe or made of metal by shaping in which a ball is pressed onto the point by means of a spring.

The ball to be used can be made of cemental carbides, stainless steel, ruby, ceramics, etc. and have a diameter of about 0.3 to 1.2 mm.

The ink container (e.g., ink tube) to contain the ink and the ink follower is preferably a molded article of thermoplastic resins, such as polyethylene, polypropylene, and polyethylene terephthalate, in view of prevention of evaporation of ink and productivity. A transparent, colored transparent, or semitransparent ink container makes it possible for the user to confirm the color or the residual amount of the ink and also produces a unique effect of design. The ink tube can be connected to the tip either directly or via a connecting member.

The ballpoint pen of the present invention include the type in which an ink container as a refill is inserted into a barrel and the type in which ink is directly filled into the barrel as an ink container.

The present invention will now be illustrated in greater detail with reference to Examples, but it should be understood that the invention is not limited thereto.

EXAMPLES 1,2 AND 4 AND COMPARATIVE EXAMPLE 4

The components shown in Table 1 or 2 below were mixed by stirring under heat together with a small amount of methanol, followed by allowing to cool, and the mixture was kneaded in a three-roll mill to prepare an ink follower composition.

The components shown in Table 1 below were mixed by stirring under heat, followed by allowing to cool, and the mixture was kneaded in a three-roll mill to prepare an ink follower composition.

COMPARATIVE EXAMPLES 1 TO 3

The components shown in Table 2 below were mixed by stirring under heat, followed by allowing to cool to prepare an ink follower composition.

EXAMPLES 5 TO 8 AND COMPARATIVE EXAMPLES 5 AND 6

The components shown in Table 1 or 2 below were mixed by stirring, and the mixture was kneaded in a three-roll mill to prepare an ink follower composition. In Examples 7 and 8 "Expansible mica A" was used as an additive.

The 1-minute value (at 20° C.) of the ink follower compositions prepared in Examples and Comparative Examples was measured with a spreadmeter. The results are also shown in Tables 1 and 2.

TABLE 1

| Composition (part by weight) | | Example No. 1 | 2 | 3 | 4 | 5 | 6 | 7 | 8 |
|---|---|---|---|---|---|---|---|---|---|
| Thickener | Expansible mica A*1 | 12.0 | 15.0 | 10.0 | | | | 2.0** | 5.0** |
| | Aluminum stearate*2 | | | | 3.0 | | | | |
| | Hydrophilic silica*3 | | | | | 3.5 | 3.0 | 3.0 | 3.5 |
| | Aluminum silicate*4 | | | | | | 2.0 | 2.0 | |
| | Acylated amino acid*5 | | | | | | | | |
| | Tribenzylidene sorbitol*6 | | | | | | | | |
| | Dextrin fatty acid ester*7 | | | | | | | | |
| | Organic bentonite*8 | | | | | | | | |
| Additive | Expansible mica B*9 | | | | | | 5.0 | | |
| | Expansible mica C*10 | | | | | 5.0 | | | |
| | Non-expansible mica A*11 | | | | 5.0 | | | | |
| | Atactic polypropylene*12 | | | 10.0 | | | | | |
| Hardly Volatile Liquid | Polybutene A*13 | 88.0 | | | 92.0 | | | | |
| | Polybutene B*14 | | | 80.0 | | | | | |
| | Polybutene C*15 | | | | | | | | |
| | Dimethyl silicone oil*16 | | | | | 91.5 | 90.0 | 93.0 | |
| | Methylphenyl silicone oil*17 | | | | | | | | 91.5 |
| | α-Olefin cooligomer*18 | | 85.0 | | | | | | |
| 1-Minute value (mm) | | 33 | 38 | 31 | 28 | 43 | 40 | 40 | 45 |

TABLE 2

| Composition (part by weight) | | Comparative Example No. 1 | 2 | 3 | 4 | 5 | 6 |
|---|---|---|---|---|---|---|---|
| Thickener | Expansible mica A*1 | | | | | | |
| | Aluminum stearate*2 | | | | | | |
| | Hydrophilic silica*3 | | | | | 3.0 | 3.5 |
| | Aluminum silicate*4 | | | | | 2.0 | |
| | Acylated amino acid*5 | 1.0 | | | | | |
| | Tribenzylidene sorbitol*6 | | 0.5 | | | | |
| | Dextrin fatty acid ester*7 | | | 3.0 | | | |
| | Organic bentonite*8 | | | | 6.0 | | |
| Additive | Expansible mica B*9 | | | | | | |
| | Expansible | | | | | | |

TABLE 2-continued

| Composition (part by weight) | | Comparative Example No. 1 | 2 | 3 | 4 | 5 | 6 |
|---|---|---|---|---|---|---|---|
| | mica C*10 | | | | | | |
| | Non-expansible Mica A*11 | | | | | | |
| | Atactic polypropylene*12 | 99.0 | | | | | |
| Hardly Volatile Liquid | Polybutene A*13 | | | 97.0 | 94.0 | | |
| | Polybutene B*14 | | | | | | |
| | Polybutene C*15 | | 99.5 | | | | |
| | Dimethyl silicone oil*16 | | | | | 95.0 | |
| | Methylphenyl silicone oil*17 | | | | | | 96.5 |
| 1-Minute value (mm) | | 33 | 37 | 35 | 28 | 43 | 47 |

*1Expansible synthetic mica having a quaternary ammonium ion, 4C-TS (trade name) produced by Topy Kogyo K.K.
*2Aluminum Stearate 103 (trade name), produced by Nitto Kasei Kogyo K.K.
*3Aerosil 200 (trade name), produced by Nippon Aerosil K.K.
*4MOX 170 (trade name), produced by Nippon Aerosil K.K.
*5Gelling agent GP-1 (trade name), produced by Ajinomoto Co., Ltd.
*6Gelol T (trade name), produced by New Japan Chemical Co., Ltd.
*7Reopearl KE (trade name), produced by Chiba Seifun K.K.
*8Baragel (trade name), produced by Rheox, Inc.
*9DP-DM (trade name), produced by Topy Kogyo K.K.
*10ME-100 (trade name), produced by Co-op Chemical Co., Ltd.
*11MK-100 (trade name), produced by Co-op Chemical Co., Ltd.
*12Vistack L (trade name), produced by Chiba Fine Chemical K.K.
*13Liquid polybutene, Idemitsu Polybutene 15H (trade name) produced by Idemitsu Petrochemical Co., Ltd.; molecular weight; 550; viscosity: 2500 cSt (20° C.)
*14Liquid polybutene, Polybutene LV-100 (trade name) produced by Nippon Oil Co., Ltd.; molecular weight: 500; viscosity: 850 cSt (20° C.)
*15Liquid polybutene, Polybutene HV-35 (trade name) produced by Nippon Oil Co., Ltd.; molecular weight: 750; viscosity: 16000 cSt (20° C.)
*16KF-96 3000 (trade name), produced by Shin-Etsu Silicone Co., Ltd.; viscosity: 3000 cSt (25° C.)
*17KF-50 3000 (trade name), produced by Shin-Etsu Silicone Co., Ltd.: viscosity: 3000 cSt (25° C.)
*18Lucant C-150 (trade name), produced by Mitsui Petrochemical Industries, Ltd.; molecular weight: 1400; viscosity: 7000 cSt (25° C.)
**Added as an additive Preparation of Ink:

Six parts (by weight, hereinafter the same) of Anthraquinone Blue, 0.3 part of xanthane gum (as a shear-thinning property imparting material), 0.2 part of polyether-modified silicone (as an additive), and 93.5 parts of water were mixed and stirred to prepare a shear-thinning aqueous ink. The resulting ink had a viscosity of 80 mPa·s as measured with an EM type rotational viscometer at 25° C. and 100 rpm and of 2000 mPa·s at 1 rpm.

Preparation of Ballpoint Pen:

A polypropylene-made tube (inner diameter: 3.8 mm) having a ballpoint tip was filled with the ink prepared above, and the ink follower composition prepared in Examples and Comparative Examples was applied to the rear end of the ink column. The resulting ink tube with a ballpoint tip was used as a ballpoint pen to be subjected to the following tests. The results obtained are shown in Table 3.

Evaluation:

(1) Visibility

The ballpoint pen was set on a spiral writing tester, and a writing test was carried out under conditions of a writing angle of 70°, a load of 100 g, and a writing speed of 4 m/min until about a half of the ink was consumed. The interface between the ink and the ink follower and whether the inner wall of the ink tube was stained with the ink after the ink follower passed by were observed. The visibility was rated as follows based on the results of observation.

AA . . . The ink/ink follower interface showed no change, and the inner wall of the ink tube was not stained with ink.

A . . . The ink/ink follower interface was slightly deformed, but the inner wall of the ink tube was not stained with ink.

B . . . The ink/ink follower interface was slightly destroyed, and the inner wall of the ink tube was slightly stained with ink.

C . . . The ink/ink follower interface was destroyed, and the inner wall of the ink tube was stained with ink.

(2) Impact resistance

The tip of the ballpoint pen was tightly sealed with a rubber stopper, and the pen was dropped from the height of 30 cm with its tip upward. The condition of the ink follower was observed and rated as follows.

AA . . . 30 drops caused no change.

A . . . 10 drops caused no change.

B . . . Less than 10 drops made the ink follower move.

C . . . Less than 10 drops made the ink and the ink follower move together.

(3) Storage stability

The tip of the ballpoint pen was tightly sealed with a rubber stopper. After the pen was allowed to stand with its tip upward at 50° C., for 1 month, the condition of the ink follower was observed and rated "pass" or "fail", as follows.

P . . . No separation in the ink follower was observed.

F . . . Part of the ink follower separated and moved to the tip along the inner wall of the ink tube.

(4) Heat resistance

The tip of the ballpoint pen was tightly sealed with a rubber stopper. After the pen was allowed to stand with its tip upward at 70° C. for 1 hour, the condition of the ink follower was observed and rated "pass" or "fail" as follows.

P . . . No change was observed.

F . . . The ink follower moved to the tip along the inner wall of the ink tube.

Further, the shear resistance of the ink follower compositions prepared in Examples and Comparative Examples was evaluated as follows. The results obtained are also shown in Table 3.

(5) Shear resistance

The ink follower composition was stirred at 3000 rpm for 5 minutes and allowed to stand for 24 hours. The 1-minute value was measured with a spreadmeter. The shear resistance was evaluated by the difference from the initial 1-minute value according to the following standard.

AA . . . The difference from the initial 1-minute value is less than 3.

A . . . The difference from the initial 1-minute value is 3 to 5.

B . . . The difference from the initial 1-minute value is 5 to 10.

C . . . The difference from the initial 1-minute value is more than 10.

TABLE 3

| | Example No. | | | | | | | | Comparative Example No. | | | | | |
|---|---|---|---|---|---|---|---|---|---|---|---|---|---|---|
| | 1 | 2 | 3 | 4 | 5 | 6 | 7 | 8 | 1 | 2 | 3 | 4 | 5 | 6 |
| Visibility | AA | AA | AA | A | A | A | AA | AA | C | C | C | B | C | C |
| Impact Resistance | A | A | AA | AA | A | A | A | A | A | A | A | B | A | A |
| Storage Stability | P | P | P | P | P | P | P | P | F | F | F | P | P | P |
| Heat Resistance | P | P | P | P | P | P | P | P | P | P | F | P | P | P |
| Shear Resistance | AA | AA | AA | A | A | A | A | A | C | C | B | B | A | A |

While the invention has been described in detail and with reference to specific embodiments thereof, it will be apparent to one skilled in the art that various changes and modifications can be made therein without departing from the spirit and scope thereof.

This application is based on Japanese patent application No. Hei. 10-375064 filed on Dec. 11, 1998, herein incorporated by reference.

What is claimed is:

1. An ink follower composition for a ballpoint pen which comprises a hardly volatile liquid and expansible synthetic mica having a quaternary ammonium ion introduced therein.

2. An ink follower composition for a ballpoint pen which comprises a hardly volatile liquid, a thickener, and synthetic mica.

3. The ink follower composition for a ballpoint pen according to claim 1 or 2, wherein said synthetic mica is present in an amount of 0.2 to 30% by weight based on the total composition.

4. The ink follower composition for a ballpoint pen according to claim 1 or 2, wherein said hardly volatile liquid is polybutene, an $\alpha$-olefin cooligomer or a mixture thereof.

5. The ink follower composition for a ballpoint pen according to claim 2, wherein said hardly volatile liquid is dimethyl silicone oil, methylphenyl silicone oil, alkyl-modified silicone oil or a mixture thereof.

6. The ink follower composition for a ballpoint pen according to claim 1 or 2, which further comprises atactic polypropylene.

7. The ink follower composition for a ballpoint pen according to claim 1 or 2, wherein said composition has a 1-minute value of from 25 to 50 mm as measured with a spreadmeter at 20° C.

8. A ballpoint pen comprising:

a middle- to high-viscosity ink or shear-thinning ink;

a ball;

a tip for holding said ball at the top end thereof and for discharging said ink from said top end;

an ink container for containing said ink and for supplying said ink to said tip, said ink container communicating with the rear of said tip; and an ink follower composition according to any one of claims 1 to 2, said ink follower being applied at the rear end of said ink and following said ink with consumption of said ink.

* * * * *